United States Patent [19]

Baumann

[11] 3,970,114

[45] July 20, 1976

[54] HEALD FRAME WITH MOVABLE HOLDING ELEMENT FITTED ON THE FRAME STAVE

[75] Inventor: Hans Baumann, Horgen, Switzerland

[73] Assignee: Grob & Co. Aktiengesellschaft, Horgen, Switzerland

[22] Filed: Apr. 9, 1975

[21] Appl. No.: 566,475

[30] Foreign Application Priority Data

Apr. 18, 1974 Switzerland ..... 5396/74

[52] U.S. Cl. ..... 139/91

[51] Int. Cl.[2] ..... D03C 9/06

[58] Field of Search ..... 139/91, 92, 84, 88, 139/82

[56] References Cited

UNITED STATES PATENTS

| | | | |
|---|---|---|---|
| 1,082,317 | 12/1913 | Giardino | 139/92 |
| 1,611,396 | 12/1926 | Wattie | 139/88 |
| 2,364,982 | 12/1944 | Kaufmann | 139/92 |
| 3,251,383 | 5/1966 | Kaufmann | 139/91 |
| 3,417,787 | 12/1968 | Kaufmann | 139/91 |
| 3,417,788 | 12/1968 | Kramer | 139/92 |
| 3,424,205 | 1/1969 | Koch | 139/91 |
| 3,470,920 | 10/1969 | Kaufmann et al. | 139/91 |
| 3,874,419 | 4/1975 | Wagner | 139/91 |

FOREIGN PATENTS OR APPLICATIONS

| | | | |
|---|---|---|---|
| 916,508 | 8/1946 | France | 139/84 |
| 574,573 | 3/1958 | Italy | 139/92 |
| 344,384 | 3/1960 | Switzerland | 139/92 |
| 430,615 | 8/1967 | Switzerland | 139/91 |

*Primary Examiner*—James Kee Chi

*Attorney, Agent, or Firm*—Sughrue, Rothwell, Mion, Zinn & Macpeak

[57] ABSTRACT

The frame staves (1, 1′) of a heald frame have ribs (12, 13) on opposite sides of the stave extending toward the center of the frame. Movable holding elements (5, 26) on the staves include guide plates (6, 7) extending over the sides of the staves and having inbent edges (10, 11) that grip the ribs. The holding elements are drawn up against the staves by screw and spring arrangements.

10 Claims, 10 Drawing Figures

HEALD FRAME WITH MOVABLE HOLDING ELEMENT FITTED ON THE FRAME STAVE

BACKGROUND OF THE INVENTION

1. Field of the Invention

This invention relates to a heald frame with a movable holding element fitted on a frame stave.

2. Description of the Prior Art

Guides, driving elements, etc. must be fitted on the frame staves of heald frames. This renders it desirable to fit holding elements at any desired positions over the length of the frame stave without having to do any machining thereon. Moreover, it is desirable to be able to move all the attached holding elements easily over the length of the frame stave and to fix them again effortlessly. Until now the holding elements were fitted on T-rails or T-shaped grooves on the outside edge of the frame staves. However, it has proved to be a disadvantage that, with this arrangement, the guides could be fitted only on the outside edge of the frame stave.

It would be advantageous if the guides could be extended over the side walls of the frame staves. Such types of guides have previously been manufactured, but they are usually fixed by means of glue on the frame staves. In that the guide is extended over the side walls of the frame stave and not only fitted at its outside edge, a sturdier and more reliable guiding of the complete heald frames towards each other can be achieved.

In many cases it is necessary to remove the guides from the heald frames. This can be due to lack of space on the drawing-in machine or for the purpose of cleaning the heald frames. Such removable guides, which extend over the side walls of the frame stave, are also known in the art. They embrace the frame stave and, on account of the fixing places for the plates of the heald carrying rods and the intermediate supports, can not be moved freely over the entire length of the frame staves. Especially on frame staves that form a complete unit together with the heald carrying rods, such guides cannot be fixed because they embrace the frame staves and, therefore, hinder the moveability of the healds.

SUMMARY OF THE INVENTION

It is a principle object of the present invention to eliminate the disadvantages of known heald frames and to create a holding element which can be shifted unhindered over the entire length of the frame stave and which can be fitted at any position of the heald frame stave.

The invention fullfils this objective in that each frame stave is provided with ribs pointing towards the center of the heald frame which run over the entire length of the frame stave. The holding element is provided with groove shaped parts which grip the ribs and with a clamping device in order to secure the holding element on the frame stave.

In a preferred embodiment guide plates are connected to each other by means of at least one distance plate. The guide plates grip the frame staves at both sides and rest on either side wall of the frame stave. The free edges of the guide plates are bent and point towards the center of the heald frame.

The securing device can be loosened by means of screws which are easily accessible from outside the frame stave. The screws can, for example, press a spring device or a pressure element towards the outer small edge of the frame stave. If a spring device is used, the screw can be fitted in such a way that the screw head rests on a firm stop so that the pressure is always the same and will not cause an overstressing of the securing parts.

It will also be possible to provide a holding element with engaging parts for the connecting of a heald frame onto the driving element of the weaving machine which additionally will also serve as a guide for the neighboring heald frame.

DESCRIPTION OF THE PREFERRED EMBODIMENTS

Figure 1:
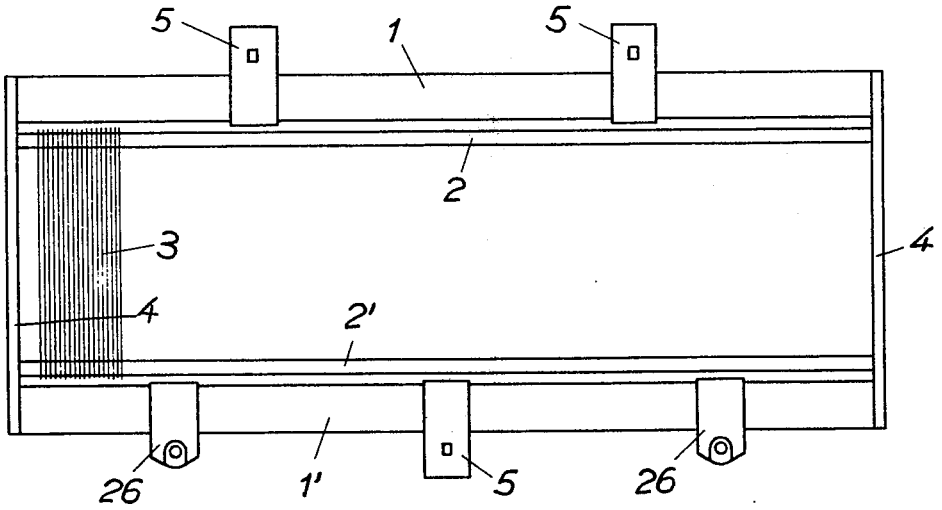
FIG. 1 shows a heald frame with two holding elements fitted on the upper frame stave and three holding elements fitted on the lower frame stave.

FIG. 1 shows a complete heald frame including an upper frame stave 1 and a lower frame stave 1'. On the respective heald carrying rods 2, 2' healds 3 are lined up. Both frame staves 1, 1' are connected by means of lateral supports 4. On the upper frame stave there are two holding elements 5 serving as guides, on the lower stave one holding element 5 serving as guide and two holding elements 26 with driving bushes 27.

Figure 3:
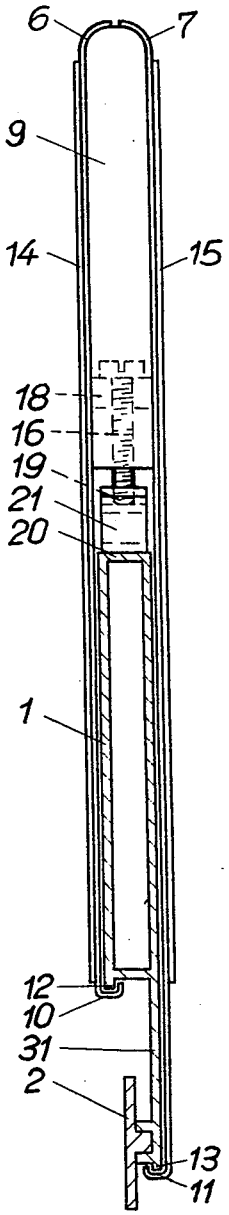
FIG. 3 shows a side view of the guide according to FIG. 2.
Figure 2:
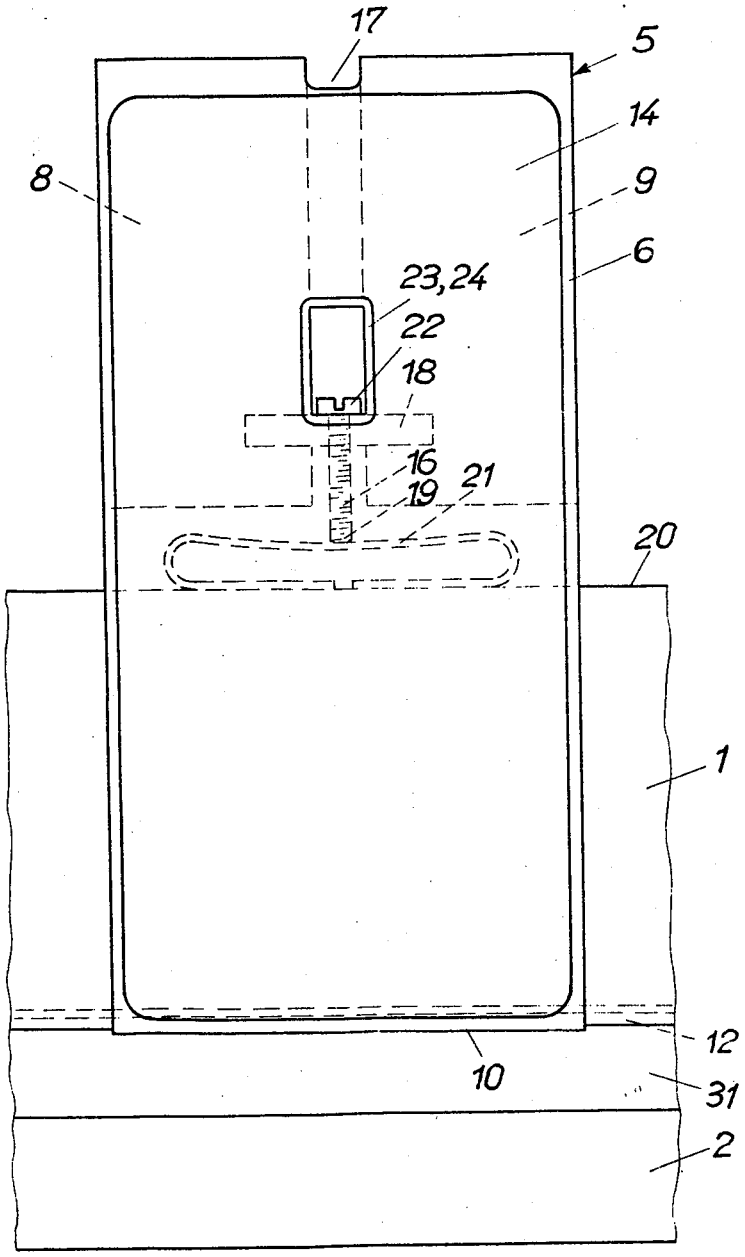
FIG. 2 shows a front view of a guide fitted on the frame stave.

FIGS. 2 and 3 show how the guides 5 are fitted on the frame stave 1. Guiding plates 6 and 7 are connected by means of distance plates 8, 9 which, for example, can be glued in. The bent parts 10, 11 of the guiding plates 6, 7 which point towards the center of the frame, grip ribs 12, 13 which are arranged on both sides of the frame stave 1. To achieve favorable gliding behavior one or both of the guiding plates 6, 7 can be covered by an abrasion proof gliding layer 14, 15 made, for example, of wood or plastic. To secure the guide 5 in the required position on the frame stave 1 a screw 16 can be inserted from above through a gap 17 formed by the two distance plates 8, 9 into a threaded plate 18. The width of this threaded plate corresponds to the thickness of the frame stave and the thickness of the distance plates 8, 9 respectively, and both ends of the threaded plate are inserted in the distance plates 8, 9 in the longitudinal direction of the frame stave 1 and thus are immovably connected with the guide 5. The lower free part 19 of the screw 16 which points towards the small edge 20 of the frame stave 1 presses on an oval shaped leaf spring 21 which is inserted between the frame stave 1 and the distance plates 8, 9. The pressure is determined by the strength and the elasticity characteristics of the leaf spring 21. The screw 16 is always completely screwed into the threaded plate 18 so that the screw head 22 rests on it.

Both the guiding plates 6, 7 and gliding layers 14, 15 are preferably provided with openings 23, 24 which permit checking whether the screw is tight or loose. In order to remove the guide 5 the screw 16 must be loosened to the extent that the pressure on the leaf spring 21 is released and then additionally loosened as much as the depth of the bent portions 10, 11 on the plates 6, 7. This assures that the guiding plates 6, 7 can be lifted over the ribs 12, 13 of the frame stave 1 and thus enables the removal of the guide 5.

FIGS. 3 – 6, 8 and 10 show different configurations of the frame stave 1 provided with ribs 12, 13 for the purpose of hanging in the holding elements.

The rectangularly shaped hollow profile 1 is provided with a protrusion 31 opposite of the outer edge, 20. The extensions of the side walls of the frame stave 1 pointing towards the center of the heald frame are formed as ribs 12, 13.

Figure 10:
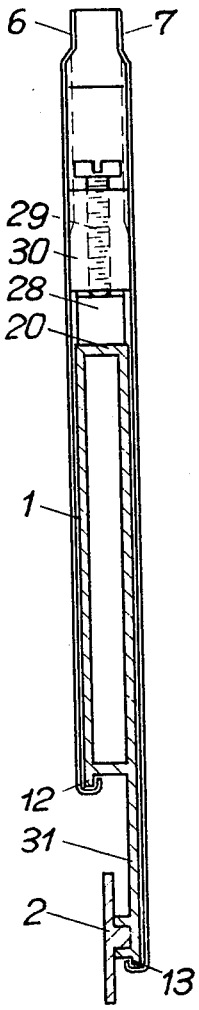
FIG. 10 shows a side section of a holding element according to FIG. 9.

In the embodiments of FIGS. 3 and 10 one of the extensions of the side walls serves simultaneously as protrusion 31 at whose end, besides the heald carrying rod 2, a rib 13 is also provided. The ribs 12, 13 which are arranged on both sides of the frame stave 1 can be arranged opposite each other or can be relatively displaced towards the center of the heald frame.

Figures 4, 5, 6, 7, 8:
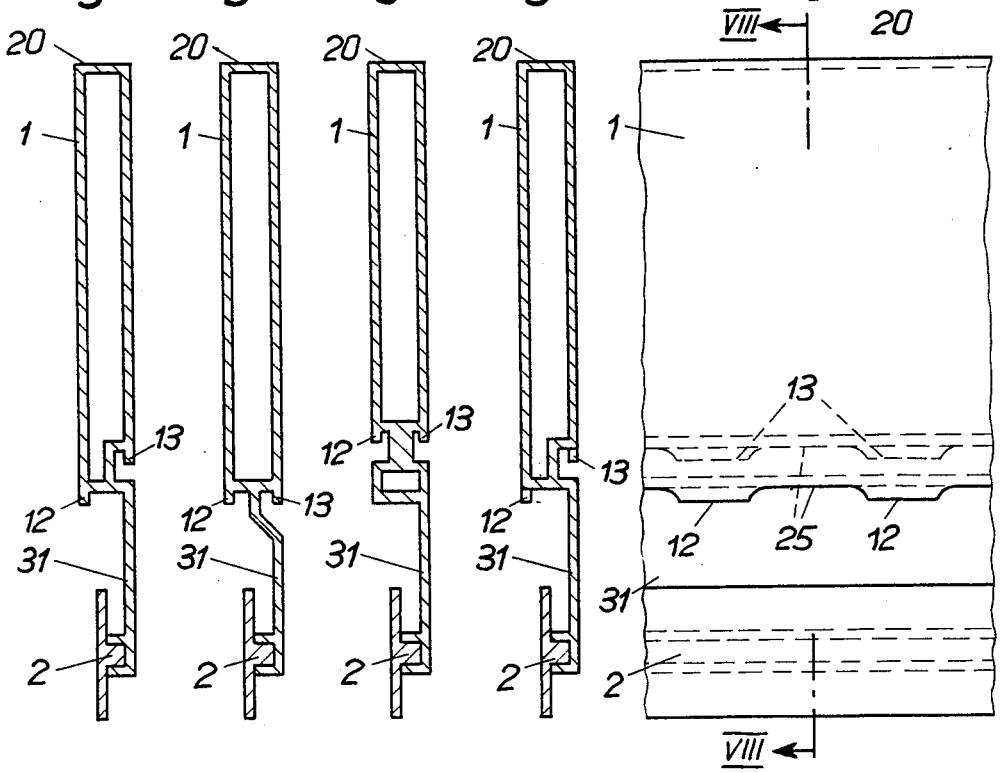
FIGS. 4 through 6 show various embodiments of frame staves in cross section.
FIG. 7 shows a further embodiment of a frame stave.
FIG. 8 shows a cross section through lines VIII—VIII in FIG. 7.

There is a possibility that during the weaving process, within the region of the ribs 12, 13 especially at the lower frame stave 1', fluff and dirt may get caught which, in the course of time, will hinder the healds 3 in their movability. FIGS. 7 and 8 show how ribs 12, 13 can be provided with recessions 25 the distances of which correspond to the widths of the shaft guides 5. Fluff which accumulates behind the ribs 12, 13 can drop out with this configuration.

Figure 9:
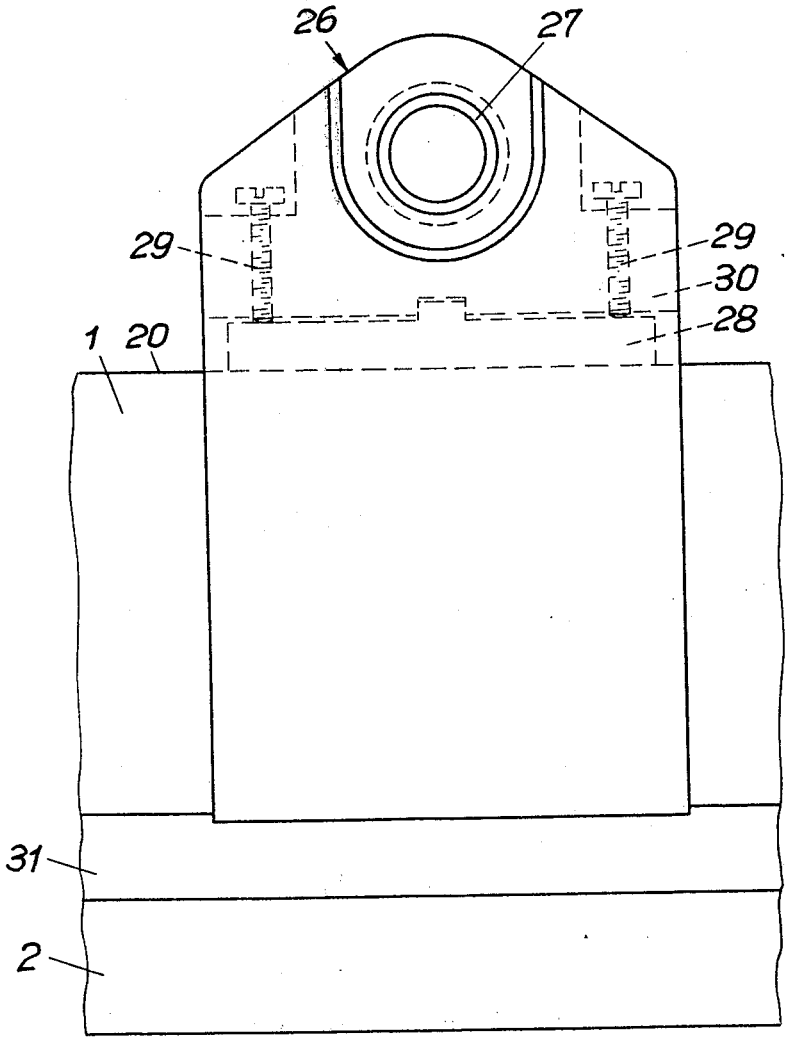
FIG. 9 shows a front view of a holding element with a driving bush fitted on a frame stave.

FIGS. 9 and 10 show an arrangement for fixing a holding element 26 with a driving bush 27 on to the frame stave 1. To secure the holding element 26 a pressure element 28 is inserted between the two guide plates 6, 7 and pressed onto the outer edge 20 of the frame stave 1 by means of two screws 29 which are inserted through the distance plate 30. The guiding plates 6, 7 can also be provided with abrasion proof glide layers 14, 15 if this will serve for a better guidance of the heald frame at the position where the holding element 26 is fixed.

What is claimed is:

1. In a heald frame assembly the improvements comprising:

a. at least one frame stave (1, 1') with a hollow, closed cross-section having generally parallel side walls, and two ribs (12, 13) extending along the length of the frame stave and protruding beyond an end wall of the cross-section toward the longitudinal centerline of the heald frame assembly, said ribs being in the same planes as the side walls of the frame stave;

b. at least one holding element (5, 26) displaceably attached to said at least one frame stave, said holding element having portions with groove-shaped sections to engage said two protruding ribs, and c. securing means (16, 21, 28, 29) to secure said at least one holding element to said at least one frame stave.

2. A heald frame according to claim 1 wherein each holding element comprises:

a. two guide plates (6, 7) contacting the side walls of the frame stave (1, 1'), said guide plates having their edges closest to the longitudinal axis of the heald frame assembly formed in a general U shape to engage the protruding ribs (12, 13) of the frame stave; and b. at least one distance plate (8, 9, 30) connected between the two guide plates, said distance plate being spaced apart from an outer wall (20) of the frame stave.

3. A heald frame according to claim 2 wherein the securing means comprises:

a. a plate (18) rigidly affixed to the distance plate (8, 9), said plate having a threaded hole therethrough;

b. a spring device (21) inserted into the space between the at least one distance plate (8, 9) and the outer wall (20) of the frame stave; and c. at least one screw (16) threaded into the hole through said plate (18) and bearing against said spring device so as to press said spring device against the outer wall (20) of the frame stave and thereby prevent undesired relative motion between the holding element and the frame stave.

4. A heald frame according to claim 2 wherein the distance plate has at least one hole therethrough and the securing means comprises:

a. a pressure element (28) inserted into the space between the at least one distance plate (30) and the outer end wall (20) of the frame stave; and b. at least one screw (29) inserted into said at least one hole through the distance plate (30) and bearing against the pressure element to press said pressure element against the frame stave to prevent undesired relative movement between the holding element and the frame stave.

5. A heald frame according to claim 1 wherein the lowermost portion of both ribs (12, 13) are the same distance from the centerline of the heald frame assembly.

6. A heald frame according to claim 1 wherein one side wall of the frame stave extends further toward the centerline of the heald frame assembly than does the remaining side wall.

7. A heald frame according to claim 2 characterized wherein at least one of the fixed guide plates (6, 7) is provided with an opening (23, 24), therethrough to adjust the securing means.

8. A heald frame according to claim 2, wherein at least one of the guide plates (6, 7) is provided with a gliding layer (14, 15).

9. A heald frame according to claim 1 wherein the holding element (26) is provided with a driving bush (27) suitable for a bolt of the frame drive.

10. A heald frame according to claim 1 characterized wherein at least one rib (12, 13) is provided with recessions (25) at spaced intervals along the length of the frame stave.

* * * * *